US005288040A

United States Patent [19]

Fox

[11] Patent Number: 5,288,040

[45] Date of Patent: Feb. 22, 1994

[54] DEVICE FOR EXCHANGING DATA BETWEEN MOVABLE UNITS AND A CENTRAL UNIT

[75] Inventor: Siegfried Fox, Xanten, Fed. Rep. of Germany

[73] Assignee: Palitex Project-Company GmbH, Krefeld, Fed. Rep. of Germany

[21] Appl. No.: 947,039

[22] Filed: Sep. 18, 1992

[30] Foreign Application Priority Data

Sep. 19, 1991 [DE] Fed. Rep. of Germany ..... 4131166

[51] Int. Cl.[5] ..... B60L 15/32

[52] U.S. Cl. ..... 246/5; 104/88; 104/301; 246/187 A

[58] Field of Search ..... 191/29 R, 30; 246/3, 246/4, 5, 6, 58, 59, 167 R, 187 R, 187 A, 187 B; 104/88, 288, 295, 296, 298, 301, 302

[56] References Cited

U.S. PATENT DOCUMENTS

| | | | |
|---|---|---|---|
| 4,093,161 | 6/1978 | Auer, Jr. | 246/5 |
| 4,244,672 | 1/1981 | Lund | 246/5 X |
| 4,393,785 | 7/1983 | Hortnagel | 191/29 R X |
| 4,570,543 | 2/1986 | Ishikura et al. | 246/187 A X |
| 4,688,487 | 8/1987 | Dollens et al. | 104/298 |
| 4,803,411 | 2/1989 | Olbrich . | |
| 4,922,830 | 5/1990 | Fujita et al. | 246/187 B X |
| 4,951,574 | 8/1990 | Tsuneda | 104/295 |
| 4,979,360 | 12/1990 | Kallmann et al. . | |
| 5,037,045 | 8/1991 | Wakabayashi | 246/187 C X |

FOREIGN PATENT DOCUMENTS

| | | | |
|---|---|---|---|
| 0047723 | 3/1982 | European Pat. Off. . | |
| 2616794 | 10/1977 | Fed. Rep. of Germany | 191/2 |
| 3420649 | 6/1984 | Fed. Rep. of Germany . | |
| 3426052 | 7/1984 | Fed. Rep. of Germany . | |
| 3629367 | 8/1986 | Fed. Rep. of Germany . | |
| 3812465 | 4/1988 | Fed. Rep. of Germany . | |
| 3813897 | 4/1988 | Fed. Rep. of Germany . | |
| 3822535 | 7/1988 | Fed. Rep. of Germany . | |
| 3823432 | 7/1988 | Fed. Rep. of Germany . | |
| 3841464 | 12/1988 | Fed. Rep. of Germany . | |
| 4011298 | 4/1990 | Fed. Rep. of Germany . | |

OTHER PUBLICATIONS

Brochure: Signalverstarker No 80311; Wampfler GmbH, Reinstr. 27, 7858 Weil am Reinh-Märkt.

Warnkecke, H. J.; Fahrbare Industrieroboter für Transportund Handhabungsaufgaben; 73, 1983; pp. 161-164.

Brochure: Elektrohängebahn-Systemplanung D S B, Mannesmann Demag, May 1985, pp. 1, 3, 17.

ASW-Handbuch für die Werkschutz Fachkraft; Elektrische Energietechnik, 34 Jun./Jul. 1989; p. 92.

Brochure: Elektroenergie-und Datenübertragung zu mobilen Geräten mit dem . . . FABA 100; Fahrleitungsbau GmbH; Jan. 1987.

JP 2-70673 A; Patent Abstracts of Japan; M-979 May 29, 1990 vol. 14, No. 251.

*Primary Examiner*—Michael S. Huppert
*Assistant Examiner*—Scott L. Lowe
*Attorney, Agent, or Firm*—Robert W. Becker

[57] ABSTRACT

A device for exchanging data between a plurality of rail-supported movable automatic manipulating units for operating a plurality of textile machines with multiple workstations and a common central unit comprises a rail system and a lead system connected to the rail system. The lead system comprises at least two and at most three data-transmitting leads that serve exclusively for data transmission in addition to supply leads for supplying electric current to the automatic manipulating units. The data-transmitting leads form a ring conduit to which the sending and receiving devices of the central unit as well as the sending and receiving devices of the automatic manipulating units are connected via additional sliding contacts. Data are sent from the sending and receiving devices in the form of impulses with a predetermined duration at predetermined intervals and each data impulse is simultaneously guided to two leads with opposite polarity. The sending and receiving devices are furthermore designed such that only such impulses are processed which are simultaneously received via both data-transmitting leads and which have a predetermined minimal signal strength.

15 Claims, 7 Drawing Sheets

DEVICE FOR EXCHANGING DATA BETWEEN MOVABLE UNITS AND A CENTRAL UNIT

BACKGROUND OF THE INVENTION

The present invention relates to a device for exchanging data between a plurality of rail-supported movable automatic manipulating units for operating a plurality of textile machines with multiple workstations and a common central unit, whereby the supply of electrical drive power to the automatic manipulating units is reached via a lead system comprising a plurality of rail-supported leads and via sliding contacts that are movable with the automatic manipulating units.

It is known to perform operating steps at a plurality of, for example, adjacently arranged textile machines with multiple workstations via automatic manipulating units that are movable on a rail system whereby their traveling path extends along the longitudinal sides of the textile machines and may be a closed circuit so that the automatic manipulating units can advance to the respective textile machines at which respective operating steps must be performed. Especially when a plurality of such automatic manipulating units are movable along one common traveling path, it is necessary to exchange data between the automatic manipulating units and a central unit which is, for example, stationary. This is necessary in order to ensure that the correct automatic manipulating unit is present at the right time at the right location in order to perform the required operating steps. It is furthermore important in this context that during their travel and operating steps the automatic manipulating units do not interfere with one another so that altogether an optimal course of operating functions may be realized. For this purpose, an undisturbed data exchange is especially important.

A transport and manipulating system for textile machines with multiple workstations of the aforementioned kind is, for example, described in the European Offenlegungschrift EP 0 384 978 A2.

In this known system, the automatic manipulating units travel along a rail system which is meander-like arranged between parallel positioned textile machines with multiple workstations. The automatic handling units are suspended from rails which are in the form of an I-beam structure. The supply of electrical drive power to the automatic manipulating units is realized via a lead system that is arranged at the vertical stay of the I-beam and which comprises a plurality of leads. The automatic manipulating units are provided with sliding contacts which rest on the leads and via which the drive power is supplied to the drive units of the automatic manipulating units.

It is known to perform the data exchange for movable automatic manipulating units connected to a rail system via leads of the lead system that supplies the electrical drive power. In such transmitting systems the data must be transmitted with a certain carrier frequency which is provided to the lead system as the energy transmitting means. Such devices are relatively complicated and cannot guarantee a disturbance-free data exchange due to the interference possibilities of external disturbances and the contacting difficulties between the leads and the sliding contacts as well as the spark generation at the point of contact.

The connection of the automatic manipulating units to a central unit via a trailing cable or similar means cannot be realized because of the complexity of the rail system and because of the possible great number of automatic manipulating units.

It is furthermore possible to perform the data exchange between the automatic manipulating units and the central unit via a wireless carrier frequency radio system. However, such systems are rather complicated and do not operate entirely reliable. Radio transmission systems are especially susceptible to disturbances from other wirelessly controlled devices which may result in transmitting flows with severe consequences.

It is therefore an object of the present invention to provide a device of the aforementioned kind which is suitable for the embodiment of a carrier frequency-free information system and which provides with a limited technical expenditure an essentially disturbance-free data exchange.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
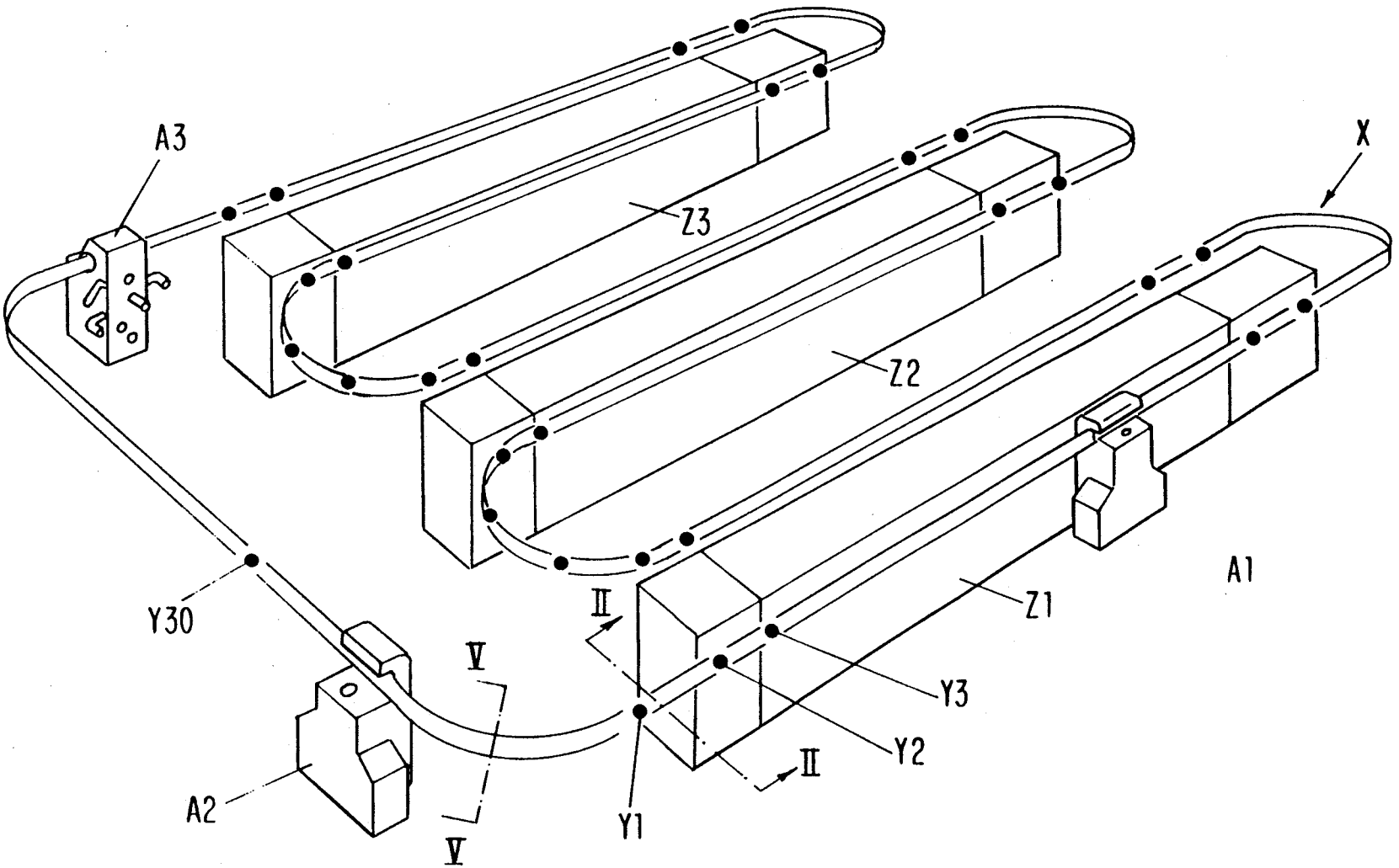
FIG. 1 is a schematic perspective view of a device with a plurality of textile machines with multiple workstations and a rail system on which a plurality of automatic manipulating units are movable.

The inventive device for exchanging data between a plurality of rail-supported movable automatic manipulating units for operating a plurality of textile machines with multiple workstations and a common central unit is primarily characterized by:

A rail system;

A lead system connected to the rail system, the lead system comprising at least two and at most three data-transmitting leads, that serve exclusively for data transmission and form a ring conduit, and further comprising supply leads for supplying electric current to the automatic manipulating units;

A central unit comprising a sending and receiving device and connected to the data-transmitting leads;

A plurality of automatic manipulating units movably connected to the rail system and each having first sliding contacts connected to the supply leads, each automatic manipulating unit having a sending and receiving device and having second sliding contacts for connecting the sending and receiving device to the data transmitting leads; and Wherein data from the sending and receiving devices are sent in the form of impulses of predetermined duration and of predetermined intervals, with each impulse sent with opposite polarity to a first and a second one of the data-transmitting leads, and wherein the sending and receiving devices are embodied such that only those ones of the impulses are analyzed that are received simultaneously via the two data-transmitting lines and have a present minimal impulse energy.

Preferably, with the sending and receiving devices only those ones of the impulses are analyzed that have a duration within a present time range.

When three of the data transmitting leads are present, a third one of the data transmitting leads serves to transmit a reference potential.

Expediently, each sending and receiving device has a transmission control unit comprising a logical operating unit, memory elements, and a level convertor, the logical operating unit and the memory elements connected to the level converter and the level converter connected to the second sliding contacts. Each level convertor has two sending channels, two receiving channels, and control switches connected to the sending and the receiving channels for alternatively connecting the sending and the receiving channels to the second sliding contact. Each receiving channel comprises a loading resistor, a surge protector circuit, a filter circuit, and a galvanic separating circuit for galvanically separating the logical operating units and for transforming a signal level of the impulses. Each sending channel comprises a galvanic separating circuit for galvanically separating the logical operating units and for transforming a signal of the impulses, and further comprising a single amplifier. One of the sending channels further has a signal invertor. The logical operating unit comprises a comparator, with the receiving channels connected to the comparator, the comparator opening a data inlet port of the logical operating unit only when two of the impulses arriving via the two receiving channels are registered simultaneously with opposite polarity.

In a further embodiment of the present invention, the inventive device further comprises limiters connected between the second sliding contacts and the level convertors. Preferably, each galvanic separating circuit comprises an optoelectronic coupler.

Expediently each automatic manipulating unit comprises an operation control unit and wherein the device further comprises interfaces for connecting the transmission control units to the operation control units such that via the interfaces only control commands to the automatic manipulating units and responses from the automatic manipulating units are exchanged.

Preferably, each transmission control unit comprises a computer. Furthermore, each transmission control unit preferably comprises an input device.

Advantageously, each automatic manipulating unit comprises sensor elements and the rail system has reference elements at fixed reference points, with the transmission control unit connected to the sensor elements for determining a position of the automatic manipulating unit on the rail system by cooperation of the sensor elements with the reference elements. Expediently, each automatic manipulating unit has the same number of sensor elements arranged in the same arrangement, and at each reference point the number of reference elements is smaller or equal to the number of sensor elements, the reference elements at each reference point arranged such that when the sensor elements pass a particular one of the reference points, a specific identification of the reference elements relative to the sensor elements results.

It is advantageous that the rail system is comprised of an I-beam structure comprised of an upper support and a lower support connected by a stay. Each automatic manipulating unit has a drive unit with drive rollers, the drive rollers engaging the upper support of the I-beam structure, the stay on one side thereof having connected thereto the lead system. The device further comprises a fastening rail connected to the other side of the stay, and holders for the reference elements, the holders detachably connected to the fastening rail.

In a further embodiment of the present invention the lead system has a further lead that is divided into predetermined longitudinal sections insulated from one another. Each automatic manipulating unit is provided with an additional safety device and a further sliding contact connected to the longitudinal sections of the further lead. The safety device has means for sending a voltage signal to the further sliding contact and/or means for detecting a voltage signal at the further sliding contact.

The gist of the present invention lies in the fact that the data exchange is performed via a separate lead system connected to the rail system with additional leads for transmitting data in the form of impulses without a carrier frequency. The lead system should be provided in the form of a ring conduit or a so-called party line via which a freely selected number of movable automatic manipulating units may be connected to the central unit. The central unit may be stationary; however, it is also possible to provide the common central unit as a movable station which is also connected to the rail system.

The difficulties that the present invention is designed to overcome are, for example, that the number of leads attachable to the commonly employed rail systems are limited due to construction limitations so that the number of channels available for data transmission cannot be freely selected. On the other hand, the transmitting distances for larger textile machine systems may well be a couple of hundred meters long. Furthermore, the leads employed for the data transmission arranged parallel to the supply leads for the drive energy are subjected to capacitive and inductive disturbances of the lead system which supplies the drive power, for example, generated by brush carbon fires or by current changes within the supply leads.

Furthermore, dust deposition and soiling of the surface of the leads during operation of the device cannot be prevented so that in the case of the data-transmitting leads changing transmitting resistances between the leads and the sliding contacts must be taken into consideration.

These difficulties have been overcome with the present invention The sending of data impulses simultaneously to two data-transmitting leads with opposite polarity provides for a so-called push-pull transmission. As will be explained infra in further detail for a specific embodiment of the present invention, it is thus possible to provide a sending and receiving device such that in this case only impulses are analyzed which are simultaneously received via both data-transmitting leads. In this manner, interference impulses are essentially eliminated. The requirement of a pre-determined minimum signal power to be received further reduces the influence of transmitting resistances due to dust deposition and soiling of the surface of the data-transmitting surfaces and the carbon brush fires. At the same time, with this measure the signal to noise ratio for interferences resulting from the supply lead system are substantially improved. In known data-transmitting devices only voltage or current signals are commonly transmitted.

For an additional suppression of interferences it may also be provided that only such incoming impulses are analyzed which have an impulse duration within a predetermined time range.

It is especially advantageous when for the data transmission three data-transmitting leads are provided whereby the third data-transmitting lead serves to transmit a reference potential which, for example, may be the ground potential.

As will be explained in more detail with the aid of a specific embodiment at a later point, it is possible for each automatic manipulating unit to combine all of the functional elements, which control and perform the data transmission process, in one transmission control unit. This transmission control unit may be provided with its own computer intelligence so that the operation control device, connected to the automatic manipulating unit and provided with commonly used memories and programmable units which control the proper work and control programs of the automatic manipulating units, is relieved. The transmission control unit may be connected with the operation control unit via respective standardized interfaces. Furthermore, the transmission units may have their own input devices via which on the site with a respective keyboard certain commands may be entered and data may be retrieved and, for example, displayed on a respective display.

The transmission of data with data impulses may be performed in a known manner with a binary code whereby each data transmission sequence may contain an address portion and an information portion. The address portion not only determines the special automatic manipulating unit designated to receive the information, but may also be connected with a priority control which is especially important when a plurality of automatic manipulating units with different functions must be coordinated according to different priorities.

When on special occasions disturbances or interferences during data transmission occur, a simple possibility check and optionally a repeat of the data transmission sequence may be easily performed.

In order for each automatic manipulating unit to send a specific positioning signal to the central unit, it is advantageous to provide the inventive device with an additional system of reference points which are arranged along the traveling path of the automatic manipulating units and which have arranged thereon reference elements cooperating with sensor elements provided at the automatic manipulating units. As will be explained in detail infra, the reference elements at the reference point must be arranged such that a specific code results so that the automatic manipulating unit is able to recognize exactly via its sensor elements at which reference point it is presently located, respectively, which reference point has been passed along the traveling path. Furthermore, it is ensured that when no data transmission is possible, for example, when the respective data-transmitting lead is busy, that the internal control within the automatic manipulating unit may independently continue to work and the respective position which has been reached is not passed.

The inventive device also provides the possibility to divide the traveling path into individual sections in analogy to a block system and to provide an additional safety device which ensures that at no time two automatic manipulating units may be present within the same sections. It is also possible to provide various priorities according to which an automatic manipulating unit will not enter a section of the rail system in which a manipulating unit with a higher priority is already present, respectively, will leave a section of the rail system into which an automatic manipulating unit of a higher priority enters. This system may be realized by providing a further lead to the lead system which is divided into predetermined longitudinal sections which are insulated from one another and by providing at each automatic manipulating unit an additional safety device coupled with the transmitting control unit which via a sliding contact is in contact with the longitudinal sections of the additional lead. The safety device comprises means for sending a voltage signal to the sliding contact and/or means for detecting a voltage signal at the sliding contact. In this manner, for example, the automatic manipulating unit of a higher priority may send a voltage signal that is detected by the automatic manipulating unit of a lower priority and which initiates respective control functions.

DESCRIPTION OF PREFERRED EMBODIMENTS

The present invention will now be described in detail with the aid of several specific embodiments utilizing FIGS. 1 through 9.

FIG. 1 shows a machine assembly comprised of three textile machines Z1, Z2, and Z3 with multiple workstations. These textile machines, for example, may be double twisting machines. A rail system X is guided through this textile machine whereby its traveling path is meander-like guided along all of the longitudinal sides of the individual textile machines Z1, Z2, Z3 and which supports in the disclosed embodiment three automatic manipulating units A1, A2, A3. For example, the automatic manipulating units A1 an A2 may perform the spool exchange at the machines Z1. Z2, Z3 while the automatic manipulating unit A3, for example, may perform cleaning and maintenance functions. The exact embodiment of such automatic manipulating units is well known in the art and need not be described in further detail. One embodiment of such automatic manipulating units is, for example, disclosed in the aforementioned Offenlegungsschrift EP 0 384 978 A2.

Along the rail system X reference points are provided which in FIG. 1 have the reference numerals Y1, Y2, Y3, to Y30. These reference points are recognized by the automatic manipulating units A1, A2, A3 in order to determine their position in a manner which will be described in detail in the following paragraphs. Respective signals for the determined position are sent to a stationary central unit via the inventive device for exchanging data between the automatic manipulating units and the central unit. via the inventive device commands may be sent to the automatic manipulating units that are located in a section between two reference points along the traveling path or supposed to leave such a section or supposed to travel to a certain reference point in order to await certain information.

Figure 2:
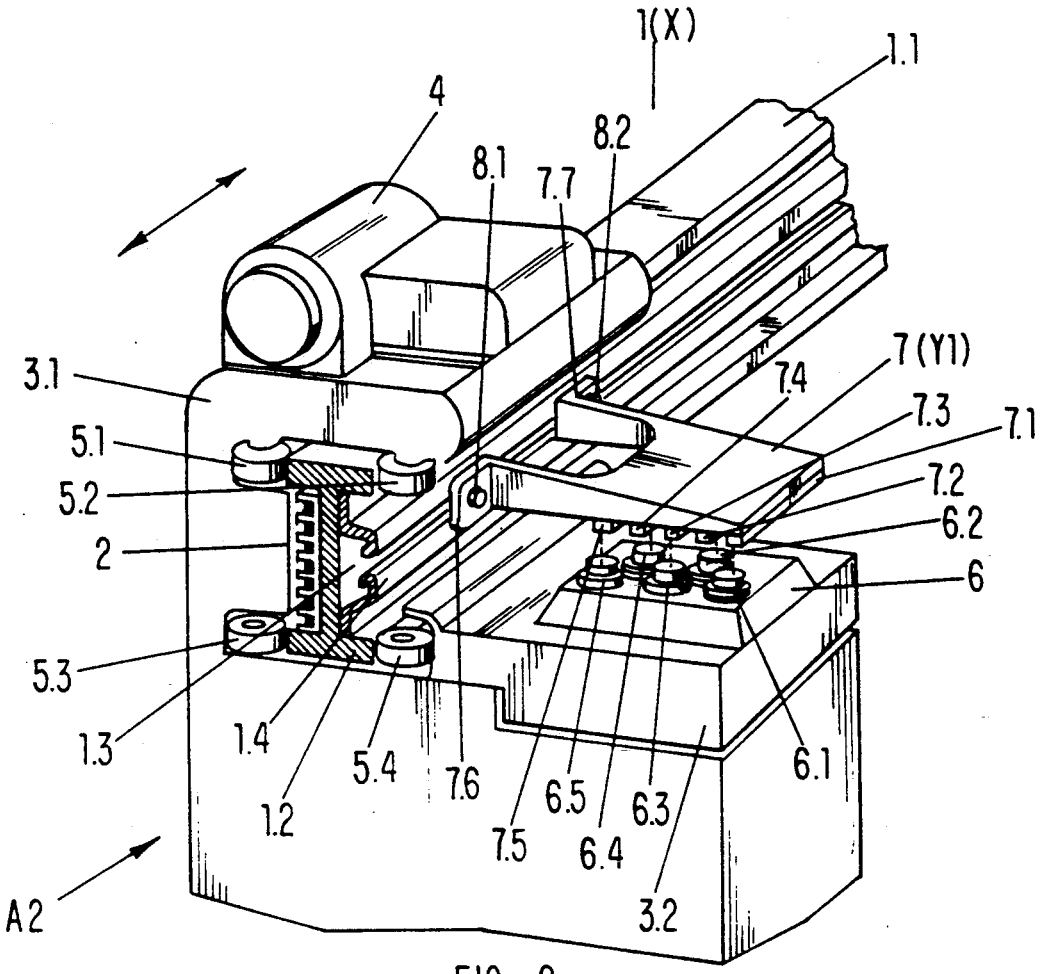
FIG. 2 is an enlarged perspective representation along the line II—II of FIG. 1 showing a partial view of one of the automatic manipulating units connected to the rail system in the area of a reference point.
Figure 3:
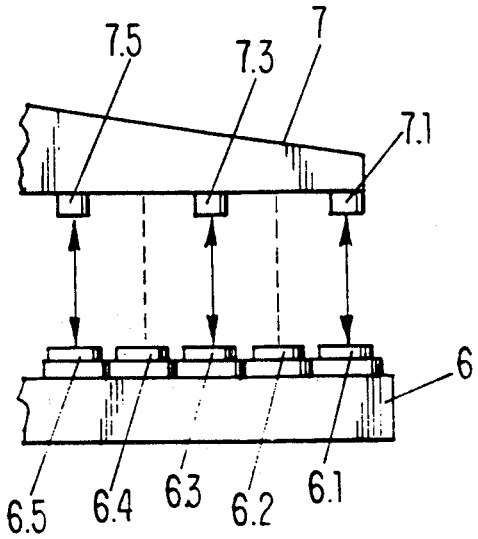
FIG. 3 shows a side view of a first embodiment of the sensor elements and reference elements of the automatic manipulating unit according to FIG. 2.
Figure 4:
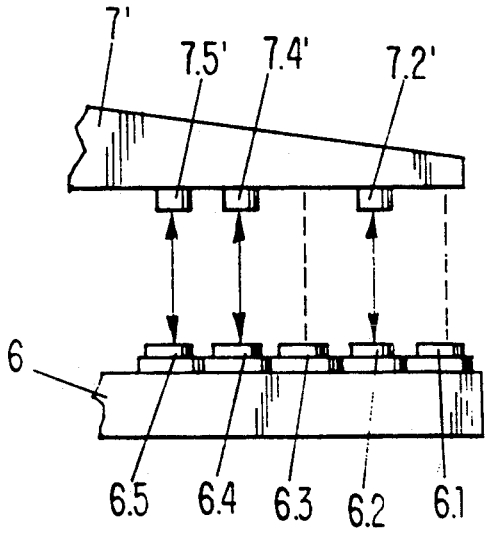
FIG. 4 shows a side view of a second embodiment of the sensor elements and reference elements of the automatic manipulating unit according to FIG. 2.

From FIGS. 2 to 4, the detailed embodiment of the reference point and the outer device components for detecting the reference points may be taken. In contrast to the representation in FIG. 1, FIG. 2 shows the automatic manipulating unit A2 at reference point Y1 of the rail system X.

At its upper end the automatic manipulating unit A2 is provided with a hook-shaped head portion with which it is suspended from the support and guide rail 1. The support and guide rail 1 is essentially an I-beam with an upper support 1.1, a lower support 1.2 and a vertical stay 1.3. A drive wheel, not represented in the drawing, of the drive unit 4 engages the upper side of the upper support 1.1. At the lateral faces of the upper support 1.1 and of the lower support 1.2 guide rollers 5.1, 5.2, 5.3, and 5.4 are engaged. The side of the stay 1.3 which is facing the head portion 3.1 of the automatic manipulating unit A2 is provided with a lead system 2 comprised of a plurality of leads which will be explained in detail infra. The lead system 2 is connected in a non-represented manner, well known in the art, via sliding contacts with the drive and control units as well as with the device for exchanging data of the automatic manipulating unit A2.

At the side of the stay 1.3 which is facing away from the head portion 3.1 a fastening rail 1.4 is attached which has the shape of a slotted C-profile. This fastening rail 1.4 serves on the one hand in a known and not further detailed manner for receiving holders via which the I-beam-shaped rail 1 is connected to a support frame. Furthermore, the fastening rail 1.4 serves to receive a device which embodies the reference points of the traveling path of the rail system X. This device is comprised of a flat holder 7 that is screwed via flanges 7.6 and 7.7 and screw connections 8.1 and 8.2 to the fastening rail 1.4. This attachment, for example, may be achieved by known self-locking hammer bolts. The holder 7 extends perpendicular to the stay 1.3 and its underside is essentially horizontal. At its underside bar- or strip-shaped reference elements 7.1 to 7.5 made of ferromagnetic material such as steel or iron are connected. At the upper side 3.2 of the automatic manipulating unit A2, which is opposite to the underside of the holder 7, a sensor device 6 is arranged which in the chosen embodiment is provided with five sensor elements 6.1 to 6.5. These sensor elements are embodied as inductive proximity sensors which send a signal in a manner known per se as soon as they are directly opposite to the reference elements 7.1 to 7.5. The sensor device 6 is connected to the data transmitting control device of the automatic manipulating unit.

The code for the respective reference points Y1 to Y30 may be embodied via the sensor and reference elements such that each sensor element 6.1 to 6.5 corresponds to one position of a binary number, whereby within the code a "1" is realized when the sensor element is located opposite a reference element and a "0" is generated when no reference element is located opposite the sensor element. Due to the varying number and arrangements of the reference elements 7.1 to 7.5 at the holder 7 of the various reference points Y1 to Y30 all reference points may be specifically marked with a five digit binary code. For detecting a position at least one sensor element must send the signal "1".

FIG. 3 shows a holder in which the reference elements 7.1, 7.3 and 7.5 are present and which are oppositely arranged to the sensor elements 6.1, 6.3, and 6.5, while no reference elements are located opposite the sensor elements 6.2 and 6 4 This arrangement corresponds to a binary code "10101" for the respective reference point. In an analogous manner FIG. 4 represents a reference point in which only reference elements 7.2', 7.4', and 7.5' are present which are opposite to the sensor elements 6.2, 6.4 and 6.5 so that a respective binary code "01011" results.

Figure 5:
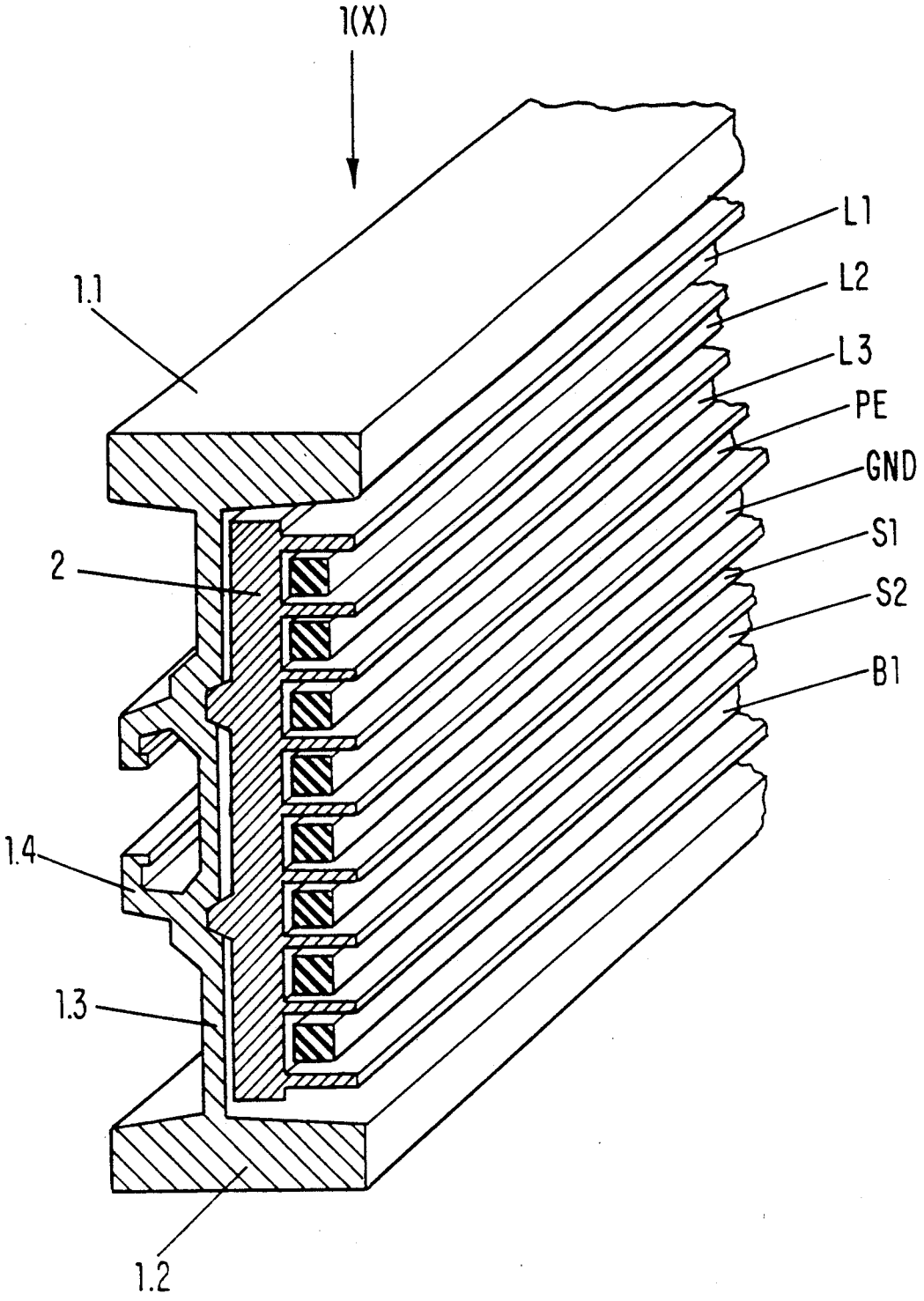
FIG. 5 is a section along the line V—V in FIG. 1 showing the rail system in an enlarged perspective representation.

FIG. 5 shows the detailed embodiment of the I-beam rail 1 of the rail system X with the lead system 2 connected to the stay 1.3. In a support comprised of insulating material eight leads extending in the longitudinal direction are provided which may be in the form of copper glide rails. In FIG. 5 they are indicated with reference numerals L1, L2, L3, PE, GND, S1, S2, and B1.

Figure 6:
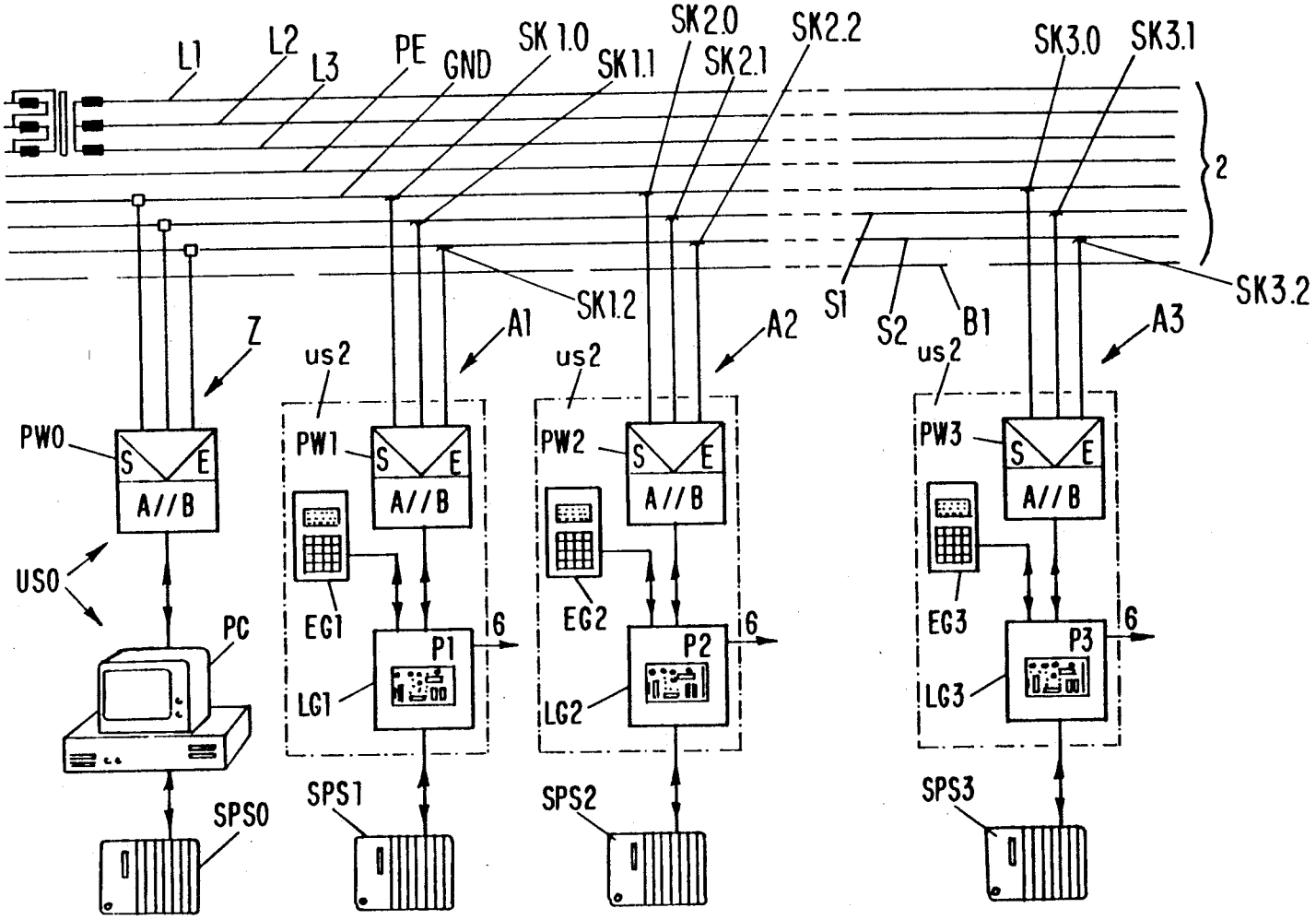
FIG. 6 is a circuit diagram of the inventive device for exchanging data according to FIGS. 1 through 5.

In the circuit diagram of FIG. 6 the inventive device for exchanging data between the automatic manipulating units A1, A2, A3 and a common central unit Z these leads are indicated with the same reference numerals. Electrical drive power in the form of three-phase current of, for example, 42 V is supplied via the supply leads L1, L2, L3 and the neutral wire PE in a manner known per se. The data-transmitting leads S1, S2, and GND serve exclusively for transmitting data whereby the lead GND represents a reference potential, in general the ground potential, while the leads S1 and S2 serve to transmit signals in a pull-push fashion as will be explained in detail infra. The lead B1 which is divided into individual longitudinal sections, insulated from one another, belongs to an additional safety device the function of which will be explained at a later point.

The common central unit Z is connected to the leads GND, S1 and S2 via a fixed wiring while the automatic manipulating units A1, A2, and A3 are connected via sliding contacts SK1.0, SK1.1, SK1.2, respectively, SK2.0, SK2.1, SK2.2 respectively, and SK3.0, SK3.1, and SK3.2, respectively, to the leads. The common central unit Z as well as the automatic manipulating units A1, A2, A3 each have a transmitting control unit (a central sending and receiving device and unit sending and receiving devices, respectively) which is indicated with reference numerals US0, US1, US2 and US3. Each transmitting control unit contains a level converter PW0, PW1, PW2, and PW3 which will be explained in detail infra. The level convertor PW0 of the common central unit Z is connected to a computer PC as well as to an operation control unit SPSO with programable memories. The level converters PW1 to PW3 are connected to other logical operating units LG1, LG2, and LG3 of the transmitting control unit which are furthermore connected to input devices EG1, EG2, and EG3. The input devices are each provided with a keyboard and a display so that a direct access into the logical operating units LG1 to LG3 is possible.

The transmission control units US1 to US3 are connected via standardized interfaces to the operating control units of the automatic manipulating units A1 to A3.

The division of the control unit into a transmission control unit and an operating control unit has the great advantage that the operating control units which are also usable for other data transmitting systems are completely relieved from any functions concerning data transmission. Via the standardized interfaces between the transmission control units and the operating control units only control commands to the automatic manipulating units and responses from the automatic manipulating units are exchanged.

As can be seen from FIG. 6 the signals of the sensor device 6 which are connected to the automatic manipulating units A1 to A3 are also sent to the logical operating units LG1 to LG3 via the ports P1, P2, and P3 and are processed there. The operation control units SPS1 to SPS3 receive only commands concerned with the next position Y1 to Y30 to which the automatic manipulating unit A1 to A3 should be transferred from the logical operating units LG1 to LG3. As soon as this position is reached, it is then compared to a position table memorized within the operation control unit so that the automatic manipulating unit is able to independently determine the function to be performed at this position. The automatic manipulating unit must only send a signal to the common center unit that the predetermined position has been reached.

Figure 7:
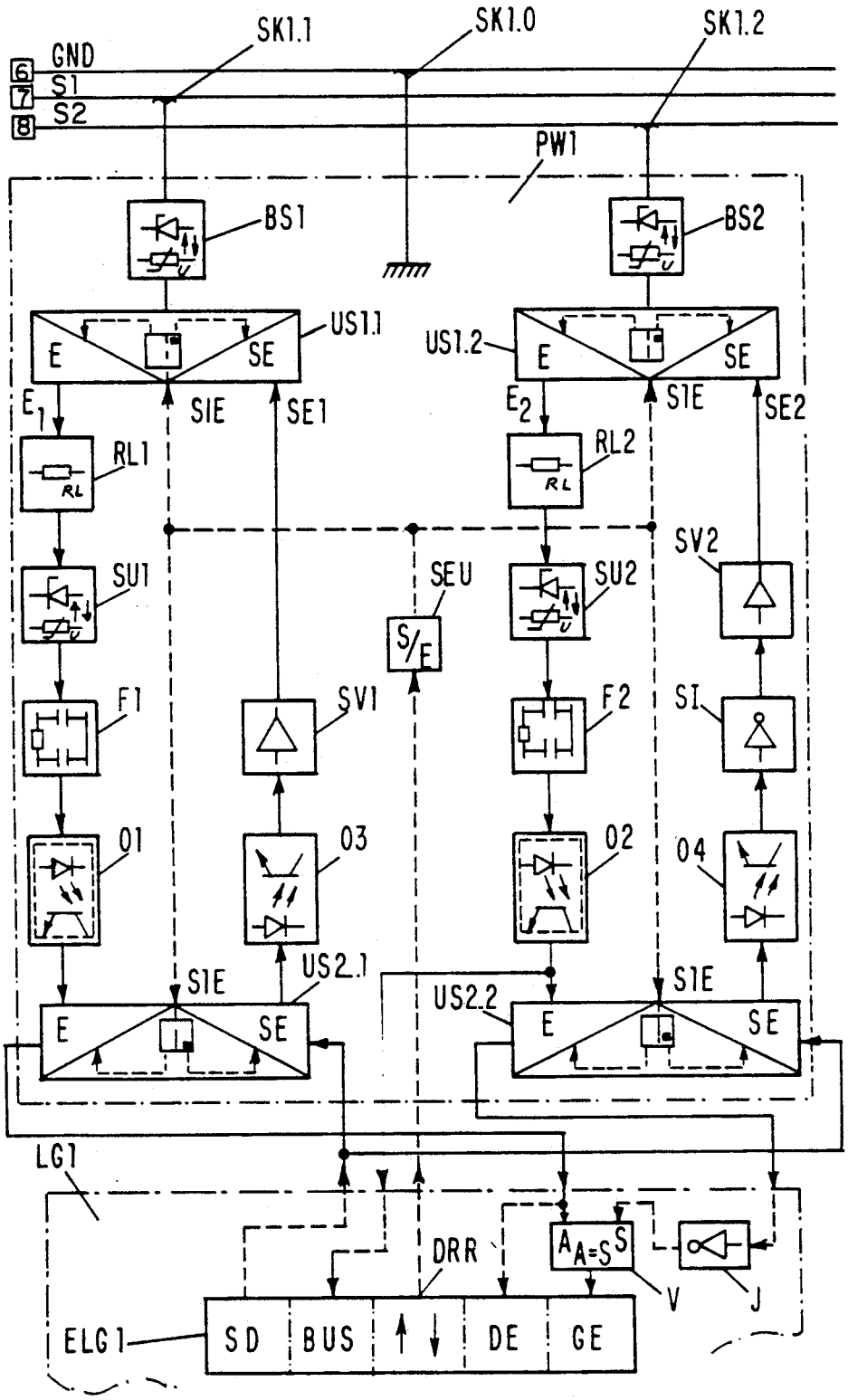
FIG. 7 is a circuit diagram of the sending and receiving device at one of the automatic manipulating units for the inventive device according to FIG. 6.

With the aid of the circuit diagram of FIG. 7 the data transmission will now be explained in more detail whereby the components of the automatic manipulating unit A1 will be used as an example.

The transmission control device (sending and receiving device) US1 has two sending and receiving channels connected to the sliding contacts SK1.1, SK1.2. The ground contact of the transmission control device US1 is connected with the sliding contacts SK1.0 in a manner not shown in detail.

In both channels the level convertor PW1 comprises at first a limiter BS1 and BS2 directly adjacent to the slide contacts which are embodied in a manner known per se and which suppress coarse disturbances of the signals supplied via the data-transmitting leads S1 and S2. Adjacent to the limiters each channel is then divided into a sending channel SE1, SE2 and a receiving channel E1, E2 which at both ends thereof have switches US1.1, US2.1, respectively, US1.2, US2.2 which may be switched by a common switching control SEU to a receiving E or sending SE mode. During normal operation the switches of all three automatic manipulating units are in the receiving position and are only switched to sending when a respective signal must be sent.

Each receiving channel E1, E2 further comprises a loading resistor RL1, RL2 as well as connected downstream thereof a surge protector circuit SU1, SU2, a filter circuit F1, F2, and a galvanic separating circuit 01, 02 for galvanically separating the remaining parts of the control device, that is the logical operating units LG1 and the memories. These circuits for galvanically separating and for transforming a signal level of the impulses preferably comprise optoelectronic couplers.

Each sending channel SE1, SE2 comprises a galvanic separating circuit 03, 04 for galvanically separating from the logical operating units and for transforming a signal level of the impulses as well as a signal amplifier SV1, SV2. Within one of the sending channels SE2 a signal invertor S1 is also provided. The two receiving channels E1 and E2 are connected via switches US2.1, US2.2 with the inlets of a comparator V whereby one of the inlets has arranged upstream an invertor J. The control outlet GE of the comparator V opens the data receiving inlet DE of the inlet step ELG1 to the logical operating units only when at both inlets simultaneously a signal impulse of the same polarity is received which corresponds to a signal impulse via the data-transmitting lead in a push-pull manner with opposite polarity.

The inlet step ELG1 of the logical operating units LG1 is further provided with a bus connected with a receiving channel E2. It is used for a bus check via which it is determined whether the data-transmitting lead contains signals to be received. If this is not the case the device may be switched to sending via the outlet DRR (data directing register) and the control SEU. The data to be sent which are exiting via the outlet SD of the input unit ELG1 are sent via the two sending channels SE1, SE2 to the leads S1 and S2 whereby they are sent via the sending channel SE1 as primary impulses and via the sending channel SE2 as opposite polarity impulses.

A processing of the data sent and received as well as their memorization and retrieval within the logical operating unit LG1 is performed in a manner known per se and is not explained in detail in this context. As mentioned before, via the additional input device EG1 which is not represented in detail in FIG. 7 a direct access on the site to the data of the memory of the logical operating unit LG1 is possible and it is also possible to directly enter commands.

The signals received via the leads S1 and S2 are provided in the form of an impulse and are coded with common coding methods. This is known per se and must not be explained any further. They may be subject to interferences and disturbances. When interference signals are received on only one of the two data-transmitting leads they are detected at the comparator B and are eliminated. Disturbances which act on both data-transmitting leads S1 and S2 result in a distortion of the received data impulses which are eliminated via the elements provided within the two receiving channels.

This will be explained in the detail with the aid of FIG. 8.

Figure 8:
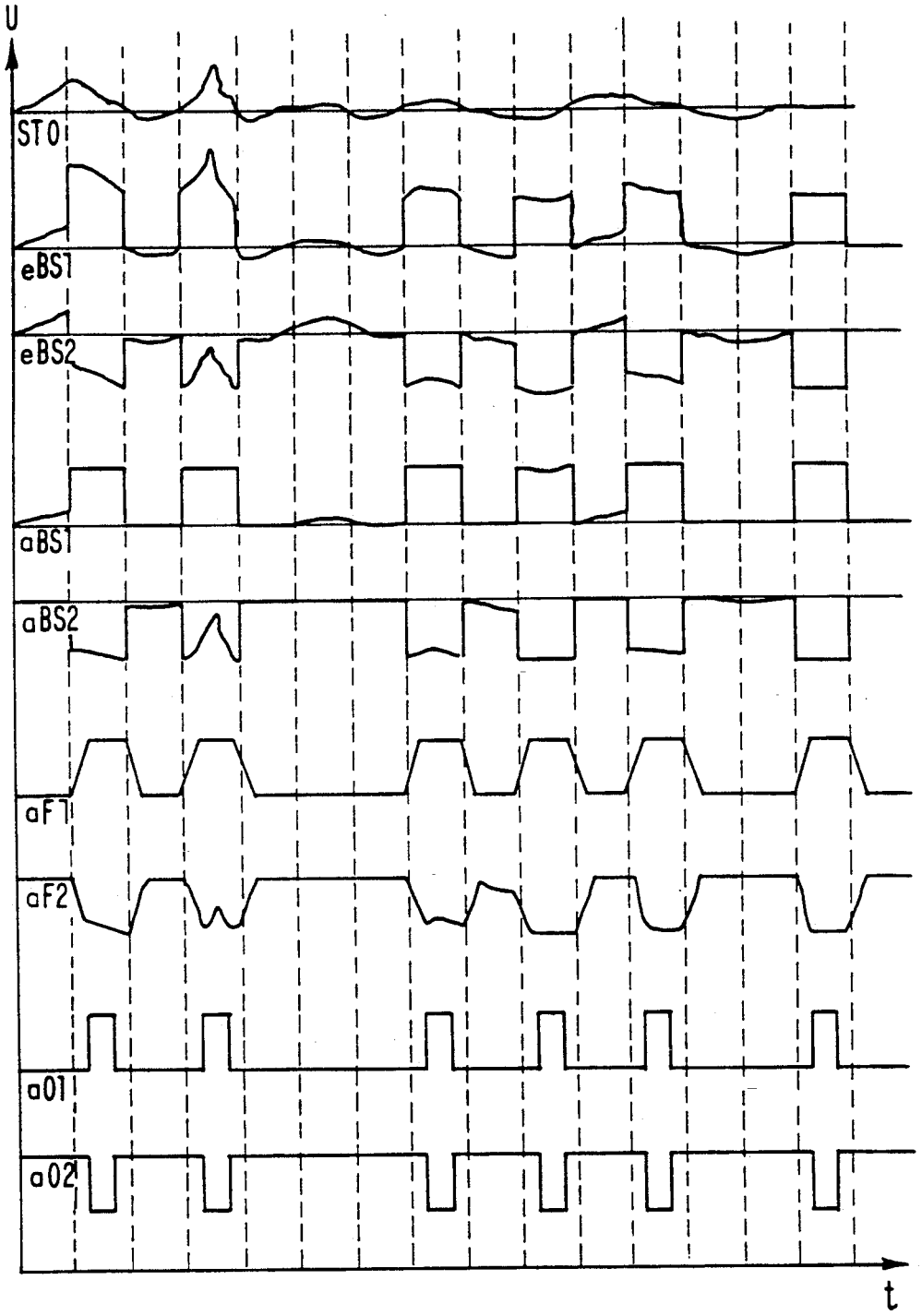
FIG. 8 shows in a voltage-time diagram the signals at individual points of the circuit according to FIG. 7.

FIG. 8 shows in a voltage/time diagram in the first line the exemplary course of a signal STO with a superimposed disturbance. In the second and third line of the diagram the two signals eBS1 and eBS2 are represented which demonstrates the influence of the data impulse before entering the two limiters BS1 and BS2. In the fourth and fifth line of the diagram the signals aBS1 and aBS2 are represented which show the signal at the outlets of the two limiters BS1 and BS2. It is obvious that the greater portions of the disturbances have already been partially compensated.

In the sixth and seventh line of the diagram the signals aF1 and aF2 are represented which show the signal at the outlet of the filter circuits F1 and F2. Due to the time constant of the filter circuits, further disturbance portions are eliminated and suppressed and the signal flanks are flatter.

Finally, the lines 8 and 9 of the diagram show signals a01 and a02 at the outlets of the galvanic separating circuits 01 and 02 for galvanically separating and for transforming a signal level of the impulse. It can be taken from the diagram that the two impulses are essentially received in a disturbance-free manner after passing through the named components. This is due to the fact that these circuits are designed such that they only respond when predetermined minimum values for the signal strength which are determined by the loading resistors RL1, RL2 are reached, i.e., a minimum voltage must be present and a minimum current must flow.

This holds true for each individual transmission control unit US1, US2, US3 connected via lines S1, S2, GNG to the central unit Z in the form of a ring line or party line. Of course, it is also possible to connect more than three movable stations to the common central unit Z. In general, the signal voltage used is within 20 to 50 V and the required minimum signal current is between 0.1 to 0.5 A so that the signal power is within the range of between 2 and 25 W. Typical values are, for example, between 10 and 20 W. For known transmitting devices the transmitted signal power is within the range of a few mW. A too great increase of the required signal energy does not seem to be useful because this would result in a less economical method and, for example, in increased expenditures for heat dissipation. Rarely occurring especially strong disturbances may be eliminated by repeating the transmission sequence, respectively, the sent impulses.

The impulses which are received at the data receiving inlet DE of the inlet step ELG1 (FIG. 7) may further be checked within the logical operating units LG1 to LG3 for a predetermined impulse duration which corresponds to the impulse duration of the impulses represented in FIG. 8 as a01 and a02. With this measure a further control of disturbance impulses is possible.

The level converter PW0 of the central unit Z (FIG. 6) in principle is constructed identical to the level converters PW1 to PW3 of the automatic manipulating units which have been described supra.

In the computer PC of the central unit Z a similar comparison of the received data impulses is performed as, for example, carried out within the comparator V of the logical operating unit LG1 as described supra. In this manner, the signals received within the central unit Z are also received in a push-pull manner and disturbance-free.

In the following an additional safety device is described with the aid of FIG. 9. This safety device prevents that two automatic manipulating units will come into such close contact that they interfere with each others function or create a dangerous situation.

Figure 9:
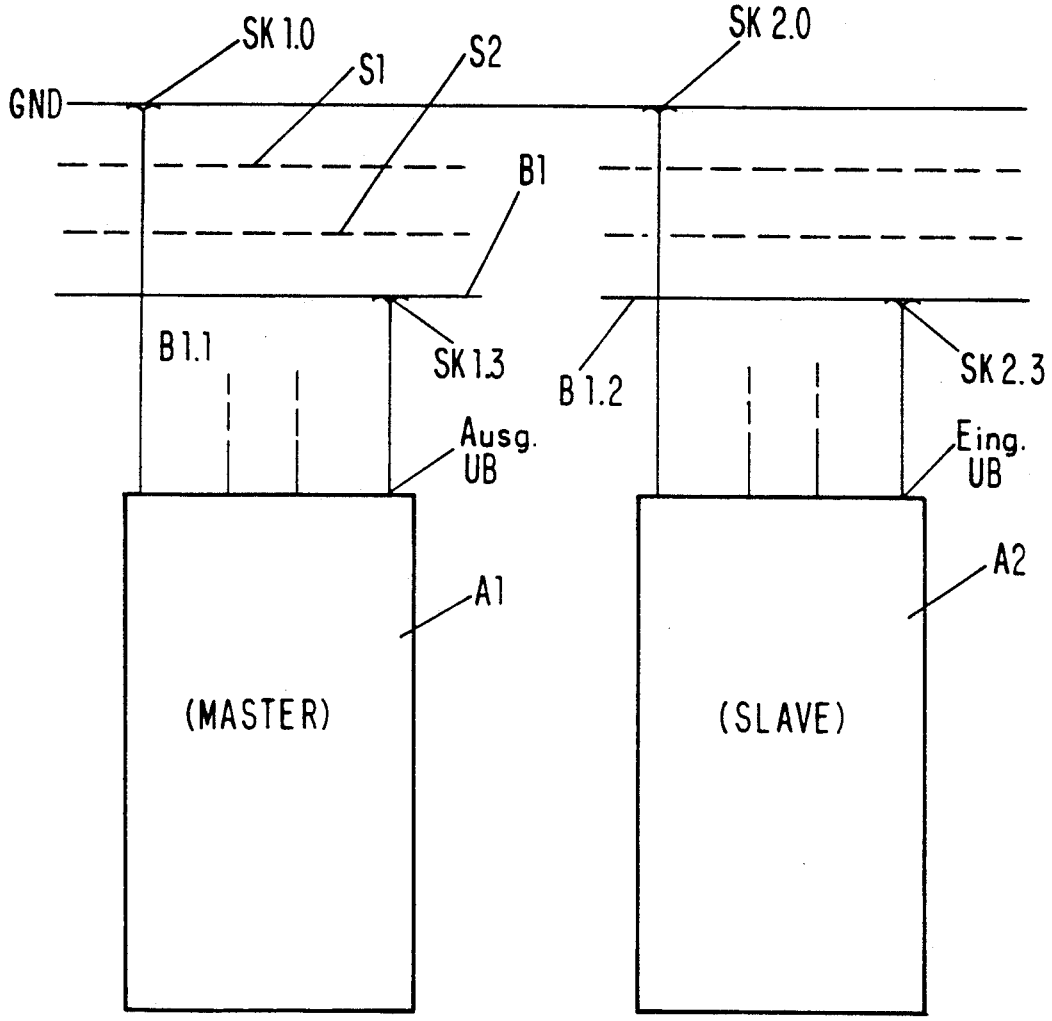
FIG. 9 shows in a simplified schematical circuit diagram an additional safety device for the inventive device according to FIG. 6.

The lead system represented in FIG. 9 shows only the lead GND which carries the reference potential as well as the aforementioned additional lead B1. This additional or further lead B1 is comprised of a plurality of longitudinal sections which are electrically insulated from one another. Two of those longitudinal sections B1.1 and B1.2 are represented. Within the section B1.1 the automatic manipulating unit A1 is identified as the "master" which indicates a higher priority. Within the longitudinal section B1.2 the automatic manipulating unit A2 is indicated as the "slave", showing that it has a lower priority. In a manner not represented in the drawing a voltage signal is generated by the automatic manipulating unit A1 and sent via the outlet UB to the sliding contact SK1.3 so that the longitudinal section B1.1 of the lead B1 has a predetermined voltage value relative to the lead GND. The automatic manipulating unit A2 is provided with a means for detecting a voltage that is connected via the inlet UB to the sliding contact SK2.3. The devices for generating a voltage and for detecting a voltage may be contained within the transmission control units US1 to US3 or the operation control unit SPS1 to SPSS. When the automatic manipulating unit A2 is moved from the section B1.2 into the section B1.1 it receives a signal corresponding to the voltage present therein via the sliding contact SK2.3 which results in a command that activates the automatic manipulating unit A2 to leave the longitudinal section B1.1 and to stop immediately. The automatic manipulating unit A1, the "master", may be programmed such that it never yields when it is in close proximity to another automatic manipulating unit while the automatic manipulating unit A2, the "slave" is programmed such that it always yields and reverses its travel direction when it receives a voltage signal that indicates that an automatic manipulating unit which is a "master" is within the same longitudinal section.

The present invention is, of course, in no way restricted to the specific disclosure of the specification and drawings, but also encompasses any modifications within the scope of the appended claims.

What I claim is:

1. A device for exchanging data between a plurality of rail-supported movable automatic manipulating units for operating a plurality of textile machines with multiple work stations and a common central unit, said device comprising:

a rail system;

a lead system connected to said rail system, said lead system comprising at least two and at most three data-transmitting leads, that serve exclusively for data transmission and form a ring conduit via which a freely selected number of said plurality of movable automatic manipulating units may be connected to said common central unit, and further comprising supply leads for supplying electric current to said automatic manipulating units;

a central unit comprising a central sending and receiving device connected to said data-transmitting leads;

said plurality of automatic manipulating units movably connected to said rail system and each having first sliding contacts connected to said supply leads, each said automatic manipulating unit having a unit sending and receiving device and having second sliding contacts for connecting said unit sending and receiving device to said data transmitting leads; and wherein data from said central and unit sending and receiving devices are sent in the from of primary pulses of predetermined duration and of predetermined intervals over a first of said data-transmitting leads, and along with each of said primary impulses is simultaneously sent opposite polarity impulses over a second one of said data-transmitting leads, and wherein said central and unit sending and receiving devices are embodied such that data are received only when the primary and opposite polarity impulses are received simultaneously via said first and second data-transmitting leads and each primary and opposite polarity impulse has a preset minimal impulse energy.

2. A device according to claim 1, wherein said central and unit sending and receiving devices only when said primary and opposite polarity impulses are analyzed and found to have a duration within a preset time range.

3. A device according to claim 1, wherein three of said data-transmitting leads are present and a third one of said data-transmitting leads serves to transmit a reference potential.

4. A device according to claim 1, wherein said lead system has a further lead that is divided into predetermined longitudinal sections insulated from one another, and wherein each of said automatic manipulating units is provided with an additional safety device and a further sliding contact connected to said longitudinal sections of said further lead, said safety device having means for sending a voltage signal to said further sliding contact.

5. A device according to claim 1, wherein said lead system has a further lead that is divided into predetermined longitudinal sections insulated from one another, and wherein each of said automatic manipulating units is provided with an additional safety device and a further sliding contact connected to said longitudinal sections of said further lead, said safety device having means for detecting a voltage signal at said further sliding contact.

6. A device according to claim 1, wherein said lead system has a further lead that is divided into predetermined longitudinal sections insulated from one another, and wherein each of said automatic manipulating units is provided with an additional safety device and a further sliding contact connected to said longitudinal sections of said further lead, said safety device having means for sending a voltage signal to said further sliding contact and means for detecting a voltage signal at said further sliding contact.

7. A device according to claim 1, wherein:

each of said central and unit sending and receiving devices has a transmission control unit comprising a logical operating unit, memory elements, and a level converter, said logical operating unit and said memory elements connected to said level converter and said level converter connected to said second sliding contacts;

each said level converter has two sending channels, two receiving channels and control switches connected to said sending and said receiving channels for alternatively connecting said sending and said receiving channels to said second sliding contacts;

each said receiving channel comprising a loading resistor, a surge protector circuit, a filter circuit, and a galvanic separating circuit for galvanically separating said receiving channel from said logical operating units and for transforming a signal level of said primary and opposite polarity impulses;

each said sending channel comprising a galvanic separating circuit for galvanically separating said sending channel from said logical operating units and for transforming a signal level of said impulses, and further comprising a signal amplifier;

one of said sending channels further having a signal inverter; and said logical operating unit comprising a comparator, with said receiving channels connected to said comparator, said comparator opening a data inlet port of said logical operating unit only when two said impulses arriving via said two receiving channels are registered simultaneously with opposite polarity.

8. A device according to claim 7, further comprising limiters connected between said second sliding contacts and said level converters.

9. A device according to claim 7, wherein each of said galvanic separating circuits comprises an optoelectronic coupler.

10. A device according to claim 7, wherein each said automatic manipulating unit comprises an operation control unit and wherein said device further comprises interfaces for connecting said transmission control units to said operation control units such that via said interfaces only control commands to said automatic manipulating units and responses from said automatic manipulating units are exchanged.

11. A device according to claim 7, wherein each of said transmission control units comprises a computer.

12. A device according to claim 11, wherein each of said transmission control units comprises an input device.

13. A device according to claim 7, wherein each said automatic manipulating unit comprises sensor elements and wherein said rail system has reference elements at fixed reference points, with said transmission control unit connected to said sensor elements for determining a position of said automatic manipulating unit on said rail system by cooperation of said sensor elements with said reference elements.

14. A device according to claim 13, wherein each said automatic manipulating unit has the same number of said sensor elements arranged in the same arrangement, and wherein at each of said reference points the number of said reference elements is smaller or equal to said number of sensor elements, said reference elements at each of reference points arranged such that, when said sensor elements pass a particular one of said reference points, a specific identification of said reference point is determined by said transmission control unit.

15. A device according to claim 13, wherein said rail system is comprised of an I-beam structure comprised of an upper support and a lower support connected by a stay, and wherein each said automatic manipulating unit has a drive unit with drive rollers, said drive rollers engaging said upper support of said I-beam structure, said stay on one side thereof having connected thereto said lead system, said device further comprising a fastening rail, connected to the other side of said stay, and holders for said reference elements, said holders detachably connected to said fastening rail.

* * * * *